United States Patent [19]

Seeger

[11] 4,437,765

[45] Mar. 20, 1984

[54] DISPERSION TURBINE

[75] Inventor: Hans-Peter Seeger, Ballrechten-Dottingen, Fed. Rep. of Germany

[73] Assignee: Ystral GmbH, Ballrechten-Dottingen, Fed. Rep. of Germany

[21] Appl. No.: 354,133

[22] Filed: Mar. 5, 1982

[51] Int. Cl.[3] ..... B01F 5/12

[52] U.S. Cl. ..... 366/264; 261/93

[58] Field of Search ..... 366/263, 264, 266, 270, 366/262, 87, 265; 261/93, 87

[56] References Cited

U.S. PATENT DOCUMENTS

| | | | |
|---|---|---|---|
| 1,720,549 | 7/1929 | Gilchrist | 366/270 |
| 2,541,221 | 2/1951 | Edwards | 366/264 |
| 3,251,580 | 5/1966 | Adams | 366/263 |
| 3,782,697 | 1/1974 | Karg | 366/266 |
| 4,002,326 | 1/1977 | Brogli et al. . | |

FOREIGN PATENT DOCUMENTS

| | | | |
|---|---|---|---|
| 2702184 | 7/1978 | Fed. Rep. of Germany . | |
| 944751 | 11/1948 | France . | |
| 819029 | 8/1959 | United Kingdom . | |
| 1305402 | 1/1973 | United Kingdom | 366/270 |

*Primary Examiner*—Robert W. Jenkins

*Attorney, Agent, or Firm*—Wood, Dalton, Phillips, Mason & Rowe

[57] ABSTRACT

A vertical axis dispersion turbine is of the type which has a stator consisting of a stator tube with a cylindrical guide ring of larger diameter than the tube defining an annular inlet, an axial rotor shaft freely rotatable in the stator tube and having several blades in the guide ring to draw a medium to be mixed and dispersed downwardly through the annular inlet, and dispersion means through which the medium flows. The dispersion means consists of a dispersion element mounted on the guide ring in a plane transverse to the rotor shaft, either immediately above or below the rotor blades, or two dispersion elements above and below the rotor blades. The dispersion elements are axially adjustable, and may consist optionally of radial arms, or a grid with axial openings or a perforated plate with axial passages. The guide ring is slidably adjustable on the stator tube.

The device may be used as a jet mixer for a medium or may be provided with a device for feeding a substance to be dispersed in the medium into the annular space between the stator tube and the rotor shaft.

16 Claims, 11 Drawing Figures

FIG.6B
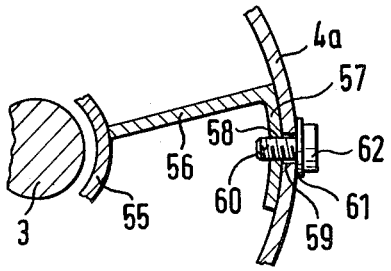
FIG.6A
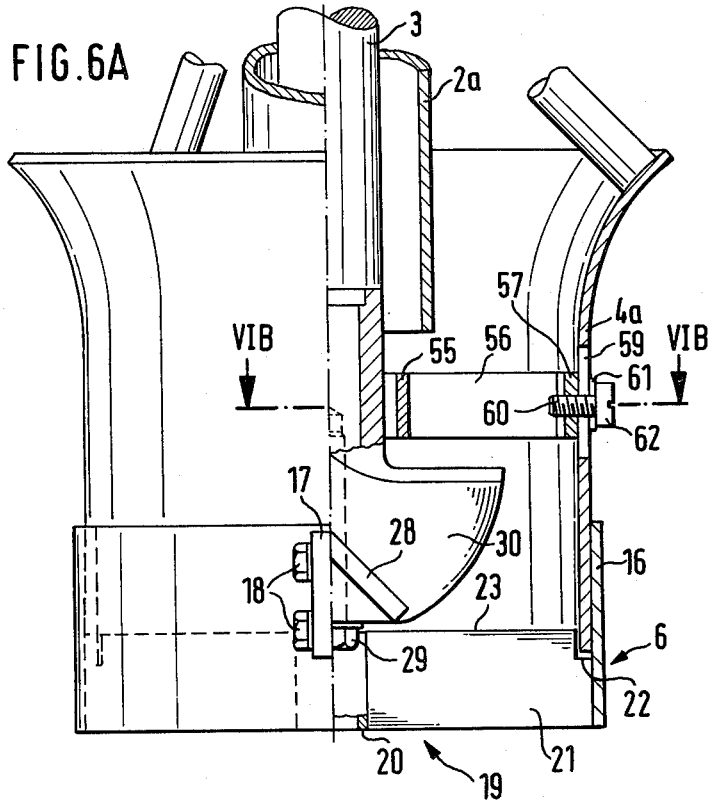
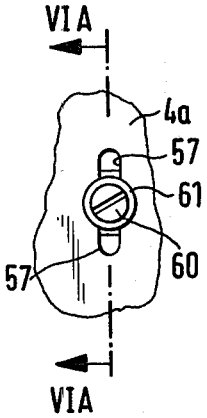
FIG.6C
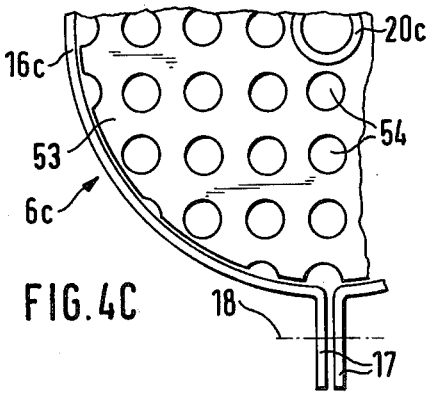
FIG.4C
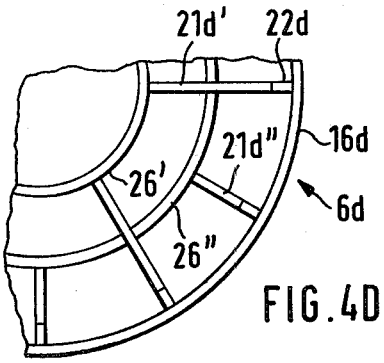
FIG.4D

DISPERSION TURBINE

The invention relates to a vertical axis dispersion turbine of the type which has a stator consisting of a stator tube with a cylindrical guide ring of larger diameter than the tube defining an annular inlet, an axial rotor shaft freely rotatable in the stator tube and having several blades in the guide ring to draw a medium to be mixed and dispersed downwardly through the annular inlet, and dispersion means through which the medium flows.

BACKGROUND OF THE INVENTION

Dispersion turbines of the present type are used for mixing, as uniformly as possible, materials which are contained in a medium and are difficult to mix, and/or for mixing substances to be fed from the outside into a medium contained in a tank, in order to produce colloidal emulsions and suspensions, and other types of colloidal mixtures without impairing the components of the respective mixture.

A well-known dispersion turbine of this type has on the lower end of the guide ring an adjustable pot-shaped dispersion ring with radially directed openings in its lower end. The rotor has a plate-like extension which has edges bent upward and in which openings are provided which rotate opposite the openings in the pot-shaped ring. The components to be mixed with each other are sucked in axially by way of the upper side of the guide ring, are mixed with each other and pushed out radially through the mentioned openings.

A dispersion turbine as above described is unsatisfactory for many purposes. For instance, processes such as the dissolving or dispersing of dry substances which have a tendency to form lumps when fed into liquids, are not properly carried out by such dispersion turbines. The desired uniform mixing is not achieved because the media may become highly viscous due to swelling of the substances in them, and do not feed properly through the radial openings. Moreover, the considerable processing and heating of the medium may cause an at least zonewise destruction of the structure or of the viscosity of the medium.

SUMMARY OF THE INVENTION

It is the purpose of the invention to provide a dispersion turbine which, with a high revolving capacity, assures an optimal dispersion effect and gentle treatment of the components of the medium.

Furthermore, a dispersion turbine is provided which is easily adjustable to different media and substances.

Furthermore, a dispersion turbine is provided which is suited for the uniform mixing of components of a medium as well as also for the mixing of a substance fed into a medium.

The foregoing results are achieved by a dispersion turbine in which the openings in the dispersion means are in an axial arrangement, with a high dispersion effect being obtained since the blades of the rotor and also the edges of the openings of the dispersion element provide a high shearing effect.

The dispersion effect can be adjusted optimally for various applications by making the guide ring and at least one dispersion element adjustable in its position relative to the rotor.

With an interchangeable dispersion element, its shape can also be adjusted for various applications. An additional selectively closable feeding device is of special advantage; here a substance to be dispersed can be drawn directly from containers, such as packing bags for dusts and powders, into the annular space between stator tube and rotor shaft by the suction effect exerted by the rotating rotor.

In the apparatus of the invention the medium is sucked from above into the guide ring by the rotor and is pushed axially downward and is sheared during the axial passage through the apparatus, in which the rotor rotates at a right angle to the feeding stream at a controlled distance from at least one dispersion element.

The apparatus is most advantageous for dispersing, or feeding and dispersing substances such as dry substances, which are not easy to feed and disperse. The dispersion turbine of the invention is considerably improved because the high revolving capacity makes possible a faster and safer sucking in of material. The energy to be used for mixing and dispersing purposes can be adjusted because of the fact that the axial relationship between the rotor, on the one hand, and the stator (of stator tube, guide ring and dispersion element), on the other hand, is adjustable.

It is especially advantageous if at least the guide ring is axially adjustable when the turbine is running, i.e. the rotor is rotating. One dispersion element can be provided above or below the rotor, or such elements may be both above and below.

Finally, a hollow rotor known per se can be used, especially if liquid, powdered or gaseous substances are supposed to be drawn in during the dispersing.

THE DRAWINGS

FIGS. 4A to 4D show further embodiments of the dispersion element;

FIG. 6A is a fragmentary sectional view similar to FIG. 3, illustrating a dispersion element provided with an alternative form of adjustment means;

FIG. 6B is a fragmentary sectional view taken substantially as indicated along the line VIB—VIB of FIG. 6A; and FIG. 6C is a fragmentary side elevational view of FIG. 6A taken substantially from the location indicated by the arrows VIA—VIA in FIG. 6C.

DETAILED DESCRIPTION OF THE INVENTION

Figure 1:
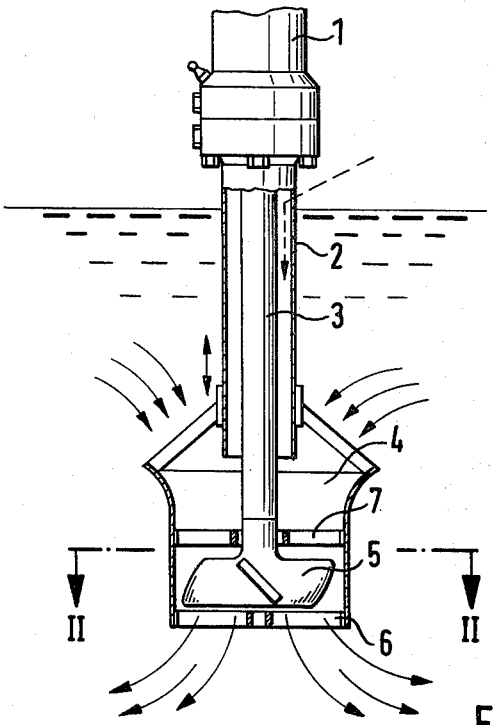
FIG. 1 is a schematic side elevational view, partly in section, of a dispersion turbine as defined in the invention.

FIG. 1 shows a vertical axis dispersion turbine embodying the invention. It has a bearing flange 1 on whose upper end a motor (not shown) can be attached and on whose lower end a stator tube 2 is fastened. Rotor shaft 3 on the axis of the stator tube 2 is rotated by means of the motor, and on the lower end of the shaft is a rotor 5 with several blades 5*a*. The rotor 5 can rotate within a guide ring 4 which is open toward the top to define an annular inlet, and which is axially adjustable on the stator tube 2 in a manner which is explained hereinafter. Below the rotor 5 and mounted on the guide ring, there is a dispersion element 6 having passages axial to the shaft 3. The dispersion element 6 is advantageously also axially adjustable as will be explained in detail.

Above the rotor 5 in the guide ring 4 is a dispersion element 7 which may be used either instead of or in addition to the dispersion element 6.

In operation, the medium present in a tank is sucked into the guide ring 4 from above according to the arrows and is again led out of the guide ring 4 axially downward by the motion of the rotor 5. On the one hand, the medium can contain the dispersion agent and the substance to be dispersed in it - with a dispersion, i.e. a collodial mixture being obtained by the passage through the guide ring 4, the rotor 5 and the dispersing element or elements 6,7. On the other hand, the medium can be formed merely by the dispersion agent and the substance to be dispersed can be fed by way of the stator tube 2 in a manner explained hereinafter. In such a case the substance to be dispersed is sucked in during the passage of the medium through the guide ring 4 according to the arrows by way of the interspace between the stator tube 2 and the shaft 3 and is distributed uniformly in the dispersion agent.

The dispersion turbine achieves, on the one hand, a high revolving capacity and, on the other hand, a high dispersing capacity based on the shearing or cutting of the delivery stream taking place approximately at a right angle. The high revolving capacity brings about also good suction behavior or draw-in behavior for the substance to be dispersed.

The desired collodial mixing of dispersion agent and substance to be dispersed is further dependent also on the respective dispersion agent and the respective substance to be dispersed. As defined in the invention, these special properties of the material can be taken into consideration by making at least the guide ring 4 vertically adjustable. Preferably at least one dispersing element 6 or 7 is vertically adjustable on the guide ring 4. In this manner, adjustments of position—specific to the material—between the stator tube 2, the guide ring 4, the rotor 5 and the dispersion element 6,7 are attainable whereby an optimal dispersion is obtained.

The various adjustments are best explained by reference to FIG. 3. The guide ring 4 is a cylinder with a flared upper end portion, and has three struts 11 connected with a mounting ring 12 which is slidable on the outside of the stator tube 2. For easy adjustment of the guide ring 4 axially on the stator tube 2, the mounting ring 12 is a split clamping ring with facing radial flanges 13 which receive screws or bolts 14 to releasably clamp the ring 12 on the stator tube 2.

On the lower end of the guide ring 4, the sole illustrated dispersion element 6 is axially adjustable on the guide ring 4. In the illustrated embodiment the dispersing element 6 has a supporting ring 16 which closely encircles the guide ring 4 and is releasably clamped onto it in the same way that the mounting ring 12 is clamped onto the tube 2. Specifically, facing radial flanges 17 on the supporting ring are pressed together by means of a screw or bolt connection 18.

The dispersion element 6 has a construction 19 which extends in a plane vertical to the axis of the rotor 5 and consists of individual elements which define axial passages.

Various constructions 19 are possible which, because of the special design of the dispersion element, are interchangeable so that any of several types of dispersion elements may be mounted on the guide ring 4 for axial adjustment.

Figure 2:
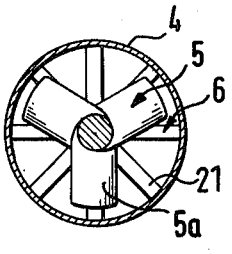
FIG. 2 is a sectional view taken substantially as indicated along the line II—II in FIG. 1.
Figure 3:
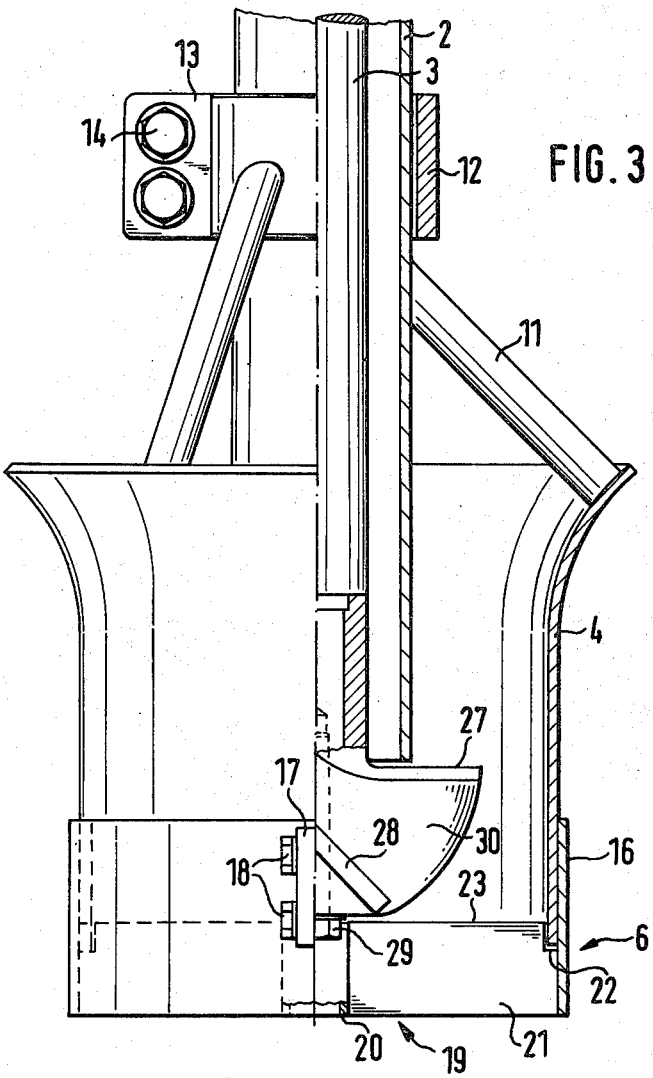
FIG. 3 is a fragmentary side elevational view partly in section, of the rotor, stator, guide ring and a first form of dispersion element for the dispersion turbine of the invention.

FIG. 3 shows a construction having a center hub 20 supporting elements in the form of radial arms 21 whose outer ends are connected with the ring 16. As illustrated on the embodiment according to FIG. 2, eight equal radial arms 21 are provided. On the upper edges 23 of the arms 21, are slots 22 in which the lower end portion of the guide ring 4 is received, whereby the upper shearing edges 23 of the radial arms 21 can be brought very close to the lower end of the rotor 30, while at the same time there is a very firm connection between the dispersion element 6 and the guide ring 4.

Figure 4A:
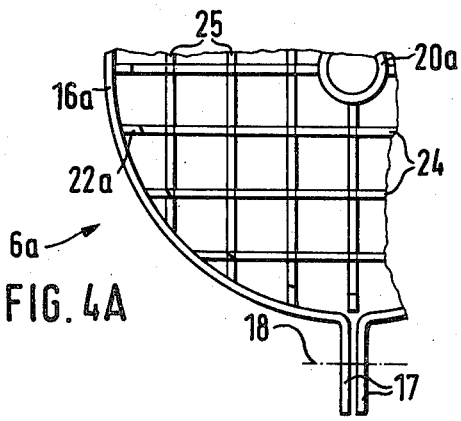

FIG. 4A shows another embodiment in which a dispersion element **6*a* has an axial lattice of webs 24 and 25 which intersect at a right angle and are connected firmly with each other and also at least with a supporting ring 16*a*, and also with a hub 20*a***. The lattice provides rectangular axial passages.

Figure 4B:
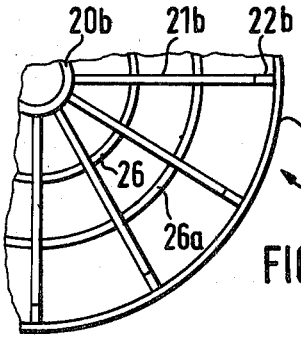

FIG. 4B shows a dispersion element **6*b* which is also formed lattice-like; however, in this case with radial arms 21*b* in which concentric ring elements 26 and 26*a*** are mounted.

As shown in detail in FIG. 3, the rotor 5 is fastened firmly but detachably on the rotor shaft 3 by means of a bolt 29 so rotors having various numbers of blades and blade configurations may be used in various applications as illustrated, for example by the rotor 5 in FIGS. 1 and 2 and the rotor 30 in FIG. 3. Also a relative adjustment of the distance between the lower end of the stator tube 2 and the upper shearing edges, as the edges 27 of the blades 28 of the rotor 30, is obtainable. The bolt 29 goes axially through the rotor and screws into an axial threaded bore of the rotor shaft 3. However, other detachable connections between the rotor 5 and the rotor shaft 3 are also possible.

Generally the guide ring 4 and any dispersion elements mounted in it are connected fixedly with the stator ring 2 in such a way that they form a part of the stator. FIG. 4C shows a dispersion element **6*c* which has a perforated disc 53 which has axial passages 54, is connected to the hub 20*c* and at least with a peripheral part with a ring 16*c*. As shown in FIG. 4D some radial arms 21*d*' of dispersion element 6*d* are connected to the inner concentric ring element 26' and the other radial arms 21*d*'' are connected to the outer concentric ring element 26'', all radial arms 21*d*' and 21*d*'' being connected to the supporting ring 16*d* and no hub being provided. Thus in the central portion of dispersion element 6*d*** is provided a flowing zone with accordingly high flow rate to suck in specific light powders.

An adjustment of the level of the guide ring 4 and/or of the dispersion element 6,7 relative to the rotor 5 is not necessary while the apparatus is in use, wherefore the illustrated clamping connections 12,13,14 and 16, 17,18 are sufficient. The adjustment of the level will take place before the start of operation, i.e. before the filling of the medium into the tank or before the inserting of the dispersion turbine into the tank containing the medium.

Obviously, connections other than the clamping connections may be used between the guide ring 4 and the stator tube 2, on the one hand, and between the guide ring 4 and the dispersion element 6,7 on the other hand. For instance, screw couplings, which are flexible in their position by means of headless screws, may be used, as may other engaging connections which can be locked in position.

If the medium contained in the tank is already a mixture of a dispersion agent, and a substance to be dispersed, devices by means of which the substance to be dispersed can be fed in are not necessary per se. The dispersion turbine as defined in the invention, however, has such a universal design that selectively the feeding of the substance to be dispersed is possible in order to make the dispersion turbine as defined in the invention applicable also for those cases where merely the dispersion agent is contained in the tank and the substance to be dispersed must be fed in. Expediently the feeding of this substance to be dispersed takes place by way of the annular space between the rotor shaft 3 and the stator tube 2, as it is explained in detail by means of FIG. 5.

For adjusting the upper dispersion element *7a* with respect to the stator part of the dispersion turbine the embodiment of FIG. 6 may be used.

Dispersion element *7a* comprises an inner ring 55, at least two radial arms 56 having an outer bent portion 57 adapted in its curvature to that of guide ring *4a*. That bent portion 57 comprises a radially extending threaded bore 58. The guide ring *4a* comprises at least two vertical slots 59 of a width which is somewhat greater as the outer diameter of threaded bore 58. From outside the guide ring *4a* a head-screw *6o* passes said slot 59 and engages threaded bore 58. A washer 61 may be inserted between the head 62 of screw *6o* and the outer face of guide ring *4a*. Through fixing said screw *6o* the upper dispersion element *7a* may be adjusted in its distance with respect to the blade of rotor *3o* and/or to the lower part of stator tube *2a*.

Figure 5:
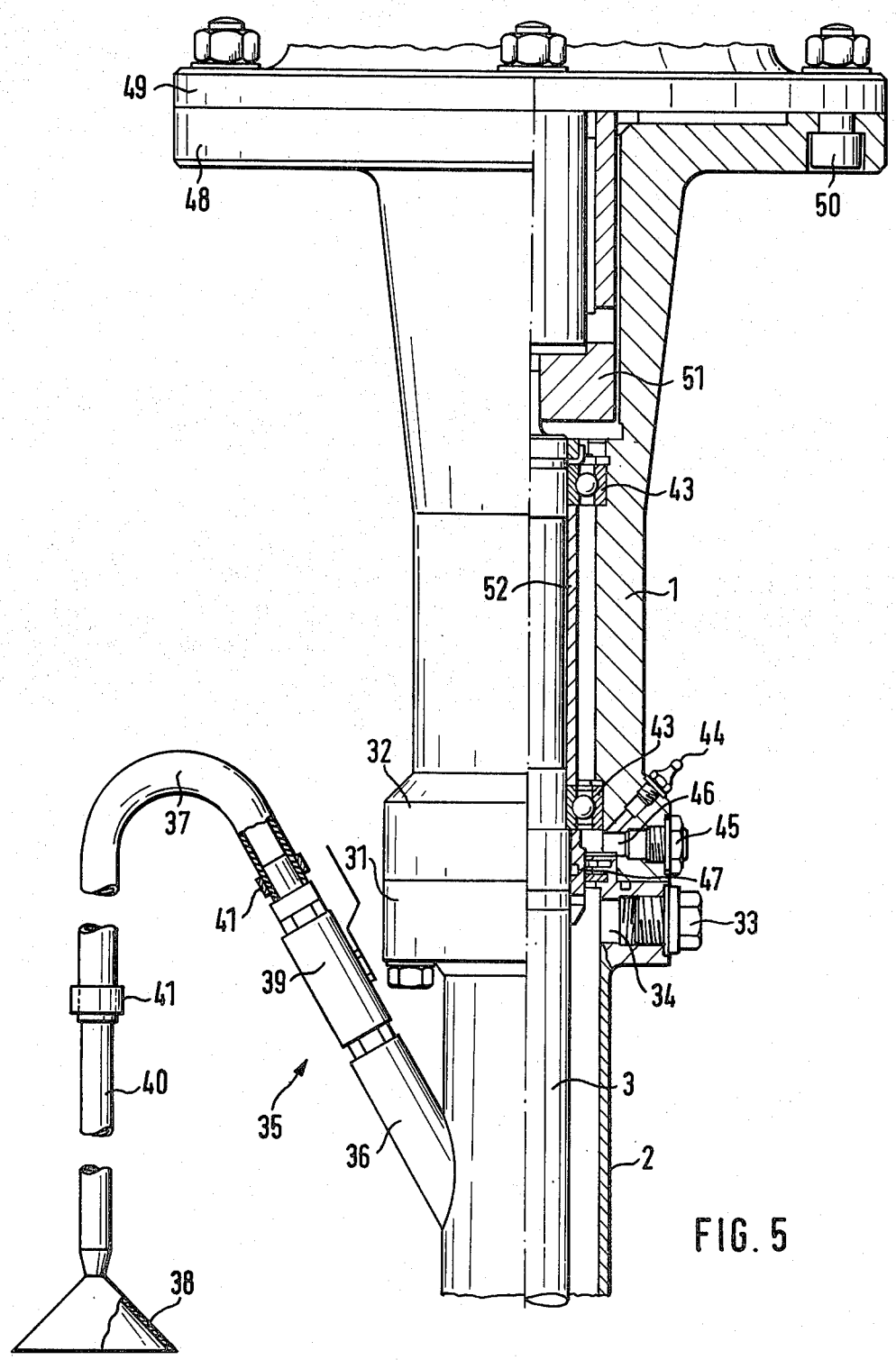
FIG. 5 is a fragmentary side elevational view, partly in section, of the upper end portion of the dispersion turbine of the invention with two alternative feeding devices for the substance to be dispersed.

As seen in FIG. 5, the stator tube 2 has on its upper end an external flange-like annular boss 31, and the bearing flange 1 has a lower, external flange-like annular boss 32 which is fastened to the boss 31, by means of screws. In the annular boss 31 there is provided a radial cleaning opening 34 which is closed tightly in the usual manner by a screw 33 and through which a cleaning agent can be fed for cleaning purposes in the usual manner when the dispersion turbine is not in operation.

Said cleaning opening 34 can also be used for feeding in a substance to be dispersed. The rotation of the rotor sucks in the substance to be dispersed through the cleaning opening 34 into the annular spaced formed between the stator tube 2 and the rotor shaft 3.

The feeding of the substance to be dispersed through the cleaning opening 34 is sufficient in many cases. However, a resistance to the flowing of the substance to be dispersed is reached, which is relatively high, and therefore a satisfactory sucking in or drawing in of the substance to be dispersed is not always assured.

The problem is overcome by a special draw-in device 35 illustrated in FIG. 5. The draw-in device 35 has essentially a pipe connection 36 on the stator tube 2, a flexible hose 37 and a suction funnel 38 on the hose 37—with a ball cock 39, or the like, to selectively close the flow-through passage between the pipe connection 36 and the hose 37. The pipe connection 36 is sloped upward and outwardly from the stator tube at an angle in the order of magnitude of 60° relative to the horizontal. Hose clamps 41 assure a tight connection between the elastic hose 37 and the ball cock 39 and between the elastic hose 37 and a pipe 40, for instance, of aluminum, put on the funnel 38, which consists preferably of plastic.

In this manner the drawing in of, for instance, powders and dusts from supply bags can be achieved simply by inserting the funnel 38 into the respective bag and by sucking and drawing in the substance, which is to be dispersed, by the underpressure produced behind the rotor 5.

The hollow bearing flange 1 serves to fix the location of the rotor shaft 3 relative to the stationary stator tube 2 which is firmly connected with the bearing flange 1. For this purpose there are provided in the interior hollow space of the bearing flange 1 bearings 43 which can be lubricated by way of a grease nipple 44, with the lubrication being monitored by means of a oil hole 45 closed by a screw 46. In order to prevent the lubricant from penetrating from the bearing flange 1 into the annular space between the stator tube 2 and the rotor shaft 3, there is provided an annular seal 47 in the zone between the two annular bosses 31 and 32.

On the upper end of the bearing flange 1 there is provided a ring plate 48 to which a three-phase motor or another driving device can be firmly connected by way of a flange 49 and bolts 50. The drive shaft of the dirving device acts, either directly or though stepup gearing or reduction gearing and a corresponding engaging coupling 51—on the upper end 52 of the rotor shaft 3 placed in the bearing 43 rotating relative to the bearing flange 1. It is evident that an extension of the rotor shaft may be obtained by means of an appropriate construction.

Also, the rotor shaft of the dispersion turbine can be a hollow shaft, known per se from German Patent application DE-OS No. 30 02 429.

The dispersion turbine as defined in the invention can thus be used, on the one hand, as a highly effective jet mixer, which has a high mixing capacity, and without drawing in air if the medium in the tank contains the dispersion agent as well as also the substance to be dispersed. On the other hand, the dispersion turbine designed as defined in the invention has a high dispersion effect if the substance to be dispersed is fed from the outside. The medium in the tank is drawn in from the top, passes through the dispersion zone axially between the rotor 5 and the dispersion element 6,7, which is essentially stationary relative to the rotor, and is cut or sheared here by the fast running rotor 5. The dispersion turbine is suited especially for the feeding of soluble dry substances, such as guar meal, etc., since by the strong dispersing effect a formation of lumps is avoided even with very high concentrations. The end product is processed very gently since by the high revolving capacity the total content of the tank is uniformly dispersed. The dispersion turbine can also be used for the feeding and finely distributing of gases in liquids as it is required, for instance, for enrichment with oxygen in clarifying basins. This means that besides gases also easily fluidizable powders such as coal dust, etc. and also liquids can be drawn in below the upper level of the medium in the tank and can be mixed in.

I claim:

1. In a vertical axis dispersion turbine which has a stator consisting of a stator tube with a lower end, an essentially cylindrical guide ring of larger diameter than said tube mounted thereon generally concentric with the lower end portion of the stator tube and extending below said lower end to define an annular chamber through which a medium to be mixed and dispersed may flow, an axial rotor shaft which is freely rotatable in the stator tube and has a rotor at its lower end with several blades inside the guide ring to draw the medium from above into and downwardly through the guide ring and dispersion means through which the medium flows, the improvement comprising:

the stator tube and the rotor shaft cooperate to define a substantially annular passage which is unobstructed throughout its length and at its lower end;

the relationship of the rotor blades to the lower end of the stator tube causes the downward flow of the medium through the guide ring to provide a venturi effect that produces a negative pressure in said annular passage;

and the dispersion means consists of a dispersion element which is mounted on the guide ring in a plane transverse to the rotor shaft near the blades of the rotor and which is constructed and arranged for axial flow of the medium therethrough so as to reduce rotational flow of the medium and enhance the venturi effect.

2. The improvement of claim 1 in which the rotor blades have upper margins which are in close proximity to the unobstructed lower end of the annular passage to maximize the velocity of the medium being mixed in the vicinity of said unobstructed lower end.

3. The improvement of claim 1 which includes means for adjusting the space between the rotor blades and the open lower end of the stator tube.

4. The improvement of claim 1 or 2 or 3 which includes means for feeding a substance to be dispersed into the unobstructed annular passage.

5. The improvement of claim 4 in which the means for feeding a substance comprises a cleaning opening in the stator tube.

6. The improvement of claim 4 in which the means for feeding a substance comprises a pipe connection on the stator tube, an external feed line communication with said pipe connection and a funnel attached onto said feed line.

7. The improvement of claim 6 in which the pipe connection is sloped upwardly and outwardly relative to the axis of the turbine, and the external feed line communicates with the outer extremity of the pipe connection.

8. The improvement of claim 7 which includes means for tightly closing the external feed line.

9. The improvement of claim 6 which includes means for tightly closing the external feed line.

10. The improvement of claim 1 in which the dispersion element is mounted on the lower end of the guide ring.

11. The improvement of claim 1 in which the dispersion element is mounted in the guide ring above the rotor.

12. The improvement of claim 1 in which there is a first dispersion element on the lower end of the guide ring and a second dispersion element mounted in the guide ring above the rotor.

13. The improvement of claim 10 or 11 or 12 which includes means for adjusting the distance between a dispersion element and the rotor.

14. The improvement of claim 1 in which the dispersion element has a hub with radiating arms.

15. The improvement of claim 1 in which the dispersion element has webs defining a lattice with axial openings.

16. The improvement of claim 1 in which the dispersion element comprises a perforated plate having axial passages.

* * * * *